US005275513A

United States Patent [19]

Geary, Jr. et al.

[11] Patent Number: 5,275,513

[45] Date of Patent: Jan. 4, 1994

[54] APPARATUS AND METHOD FOR IN-SITU TREATMENT OF A MEDIUM

[75] Inventors: James E. Geary, Jr., Boothwyn, Pa.; Keith S. Haight, Jr., Wilmington, Del.; Thomas F. Mistretta, Jr., Newark, Del.; Daniel G. Tynan, Wilmington, Del.

[73] Assignee: E. I. Du Pont de Nemours and Company, Wilmington, Del.

[21] Appl. No.: 901,651

[22] Filed: Jun. 22, 1992

[51] Int. Cl.[5] ..... E02D 3/12

[52] U.S. Cl. ..... 405/266; 405/263; 405/269

[58] Field of Search ..... 405/266, 267, 263, 232, 405/269, 258

[56] References Cited

U.S. PATENT DOCUMENTS

| | | | |
|---|---|---|---|
| 2,782,605 | 2/1957 | Wertz et al. | 405/266 |
| 3,969,902 | 7/1976 | Ichise et al. | 405/266 X |
| 4,193,696 | 3/1980 | Van Heel et al. | 366/66 |
| 4,281,934 | 8/1981 | Krause et al. | 366/30 |
| 4,652,180 | 3/1987 | Jenkins | 405/266 X |
| 4,776,409 | 10/1988 | Manchak, Jr. | 175/50 |
| 4,844,807 | 7/1989 | Manchak, Jr. | 210/682 |
| 4,844,839 | 7/1989 | Manchak, Jr. | 252/633 |
| 4,902,172 | 2/1990 | Fukuda | 405/269 |
| 5,013,185 | 5/1991 | Taki | 405/266 X |

FOREIGN PATENT DOCUMENTS

| | | | |
|---|---|---|---|
| 0037220 | 3/1983 | Japan | 405/267 |
| 0050217 | 3/1983 | Japan | 405/269 |

OTHER PUBLICATIONS

"Geo-Con DSM System", Geo-Con, Inc., Geotechnical Construction, 1991.

"Deep Soil Mixing-Technical Brief", Geo-Con, Inc., Geotechnical Construction, 1989.

*Primary Examiner*—Dennis L. Taylor

[57] ABSTRACT

An apparatus for treating a medium in situ includes counter-rotating shafts and intermeshed blades arranged on the shafts in a helical array to define mixing zones along the length of the shafts. Reagent supply conduits are disposed in a housing surrounding the upper ends of the shafts for introducing reagents into the mixing zones. The housing is attached to a mobile excavator which moves the shafts horizontally and vertically. The shafts are lowered into the medium by the excavator and are counter-rotated to cause the blades to pump the medium and the reagents along the shafts. Once at the desired operating depth, the shafts are moved below the surface of the medium in the horizontal direction generally perpendicular to the plane of the axes of the shafts to define a volume in the medium. The medium and the reagent are mixed vertically and laterally in the mixing zones and are further mixed horizontally as the mixing zones traverse the medium in the horizontal direction, thereby mixing the reagent and the medium in the volume in both the vertical and the horizontal direction to stabilize and homogenize the medium. The shafts are then withdrawn from the medium and the process is repeated for a second volume disposed adjacent the first volume. The apparatus and the method associated with operating the apparatus result in very uniform stabilization and homogenization of a medium at a rapid rate and a low cost.

19 Claims, 7 Drawing Sheets

APPARATUS AND METHOD FOR IN-SITU TREATMENT OF A MEDIUM

BACKGROUND OF THE INVENTION

1. Field of the Invention

The present invention relates to an apparatus and a method for in situ treatment of a medium, especially where the medium is sludge.

2. Description of the Related Art

In the past, industries have discharged aqueous, dry or semi-solid waste materials, chemicals, heavy metals, or mixtures of toxic or radioactive materials into impoundment ponds as a sludge-type material. Typically, these materials consist of fine particulate matter that does not have good self-adhesion properties. Such waste material may leach into the soil and contaminate the ground water and may become dried out and solid, which may present an airborne health hazard.

A preferred method for lessening the danger inherent in impounded materials has been to stabilize the impounded waste material in place, i.e., in situ. In such an in situ method, the material is stabilized by transforming it into a solid, or soil-like, substantially insoluble mass from which toxic materials will not leach out, nor will any substantial surface particles of the mass become airborne when the mass is excavated or subjected to the elements of weather. Such a method and a device used to practice such method is described in U.S. Pat. No. 4,776,409 to Manchak and U.S. Pat. No. 4,652,180 to Jenkins.

One of the most critical aspects of stabilization is thorough, complete and uniform homogenization of the medium and the stabilization reagent. Reagents injected into waste material must be uniformly blended with the waste and must uniformly react with it; to do so, a homogeneous mixture must be produced. Otherwise, unstabilized portions of waste material may remain that constitute a health hazard, and excessive amounts of reagent must be used to stabilize the most highly-concentrated regions of the toxic waste. This results in substantial increases in cost and treatment time. While both Manchak and Jenkins stabilize waste material, only Manchak additionally homogenizes the material. However, Manchak achieves only limited homogenization. This is because, in Manchak's device, only one blade is disposed at the end of shafts, leaving the medium along the length of the shafts substantially untreated after the shafts are inserted vertically into the medium.

Another approach to in situ treatment of waste material is employed in a Deep Soil Mixing (DSM) system, commercially available from Geo-Con, Inc. of Pittsburgh, Pa. In this system, as the shafts are advanced vertically below the surface of soil in an impoundment pond, a cement-based grout is injected through the hollow stems of the shafts and is discharged at the lower end of the shafts (i.e., the end of the shafts inserted into the medium). The grout and the soil are thus mixed and stabilized, although not necessarily homogenized. Such a system is shown generally at 2 in FIG. 1. A disadvantage associated with this system is that to treat all of the volumes, the shafts must be raised above the surface of the soil, horizontally advanced and then lowered again vertically below the surface of the soil in an adjacent volume. In this process, areas must be overlapped. This overlap is shown at cross-hatched areas 4 in FIG. 1, and the pattern of the horizontal advancement of the cylindrical shafts of such a prior art system is shown in outline at 6. Without this overlap, a portion of the volume is left untreated because of the edge shape of the cylindrical volumes contacted by the blades mounted on the shafts. However, this overlap results in additional time and cost in treating the soil, which are critical factors in determining whether an impoundment pond can be rapidly, economically and completely stabilized.

SUMMARY OF THE INVENTION

Therefore, it is an object of the present invention to design an apparatus and a method for in situ treatment of a medium in which there is minimal overlap between adjacent volumes when the shafts of the apparatus are advanced through the medium at successive positions.

It is further an object of the present invention to design an apparatus and a method for in situ treatment of a medium which result in uniform mixing, stabilization and homogenization of the medium at a rapid rate and a low cost.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an apparatus for in situ treatment of a medium. The apparatus comprises a plurality of counter-rotating shafts and a plurality of blades disposed on each of the shafts. A mixing zone is formed in the vertical volumetric space between each vertically adjacent blade on each respective shaft and in the laterial volumetric space between laterally spaced blades on each adjacent shaft. A plurality of reagent supply conduits are disposed in fluid communication with the mixing zones for directing at least one reagent into the medium. The medium and the reagent are pumped along the shafts in the mixing zones as the shafts counter-rotate. A mechanism is provided for moving the shafts below the surface of the medium in the vertical direction generally parallel to the plane of the axes of the shafts and in the horizontal direction generally perpendicular to the plane of the axes of the shafts to define a volume in the medium, wherein the medium and the reagent are mixed vertically and laterally in the mixing zones and are further mixed horizontally as the mixing zones traverse the medium in the horizontal direction, thereby mixing the reagents and the medium in the volume in both the vertical and the horizontal direction to stabilize and homogenize the medium.

BRIEF DESCRIPTION OF THE DRAWINGS

The accompanying drawings, which are incorporated in and constitute a part of this specification, illustrate one embodiment of the invention, and together with the description, serve to explain the principles of the invention.

DESCRIPTION OF THE PREFERRED EMBODIMENT

Reference will now be made in detail to the present preferred embodiment of the invention, an example of which is illustrated in the accompanying drawings. Whenever possible, the same reference numbers will be used throughout the drawings to refer to the same or like parts.

Figure 1:
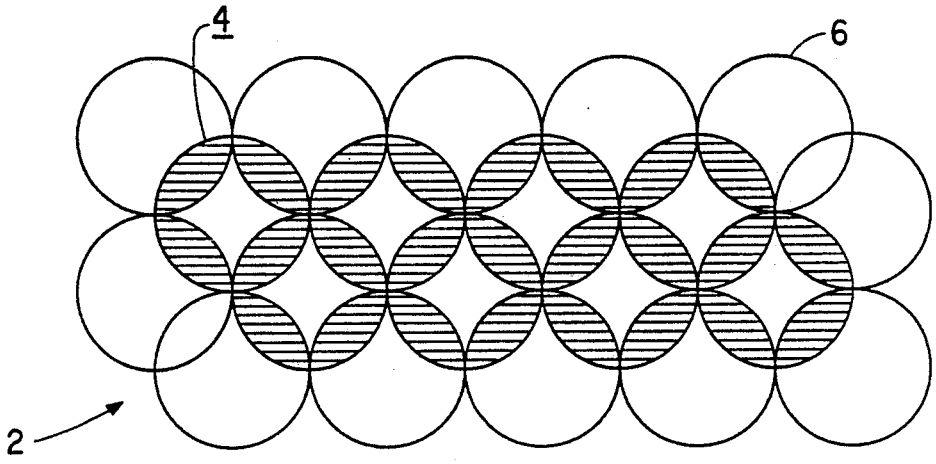
FIG. 1 (PRIOR ART)
FIG. 1 is a schematic view showing the pattern of advancement of the shafts of a system of the prior art which treats a medium in situ.
Figure 2A:
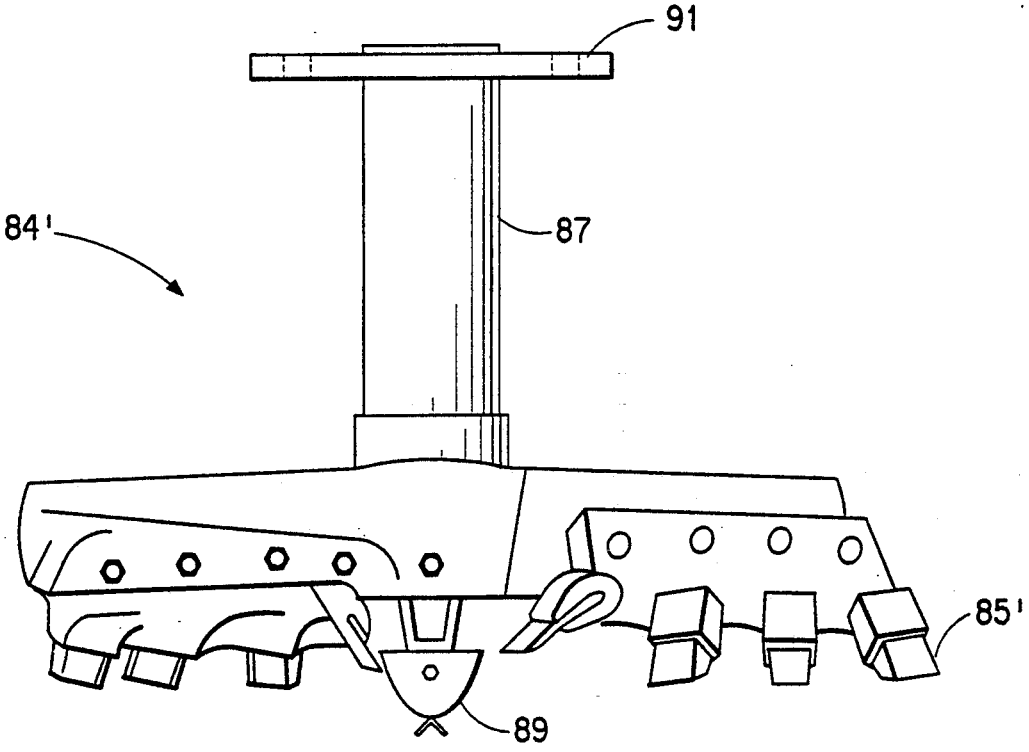
FIG. 2A is an enlarged, front elevation view of an alternate cutting tooth assembly of the apparatus as shown in FIG. 2.
Figure 2:
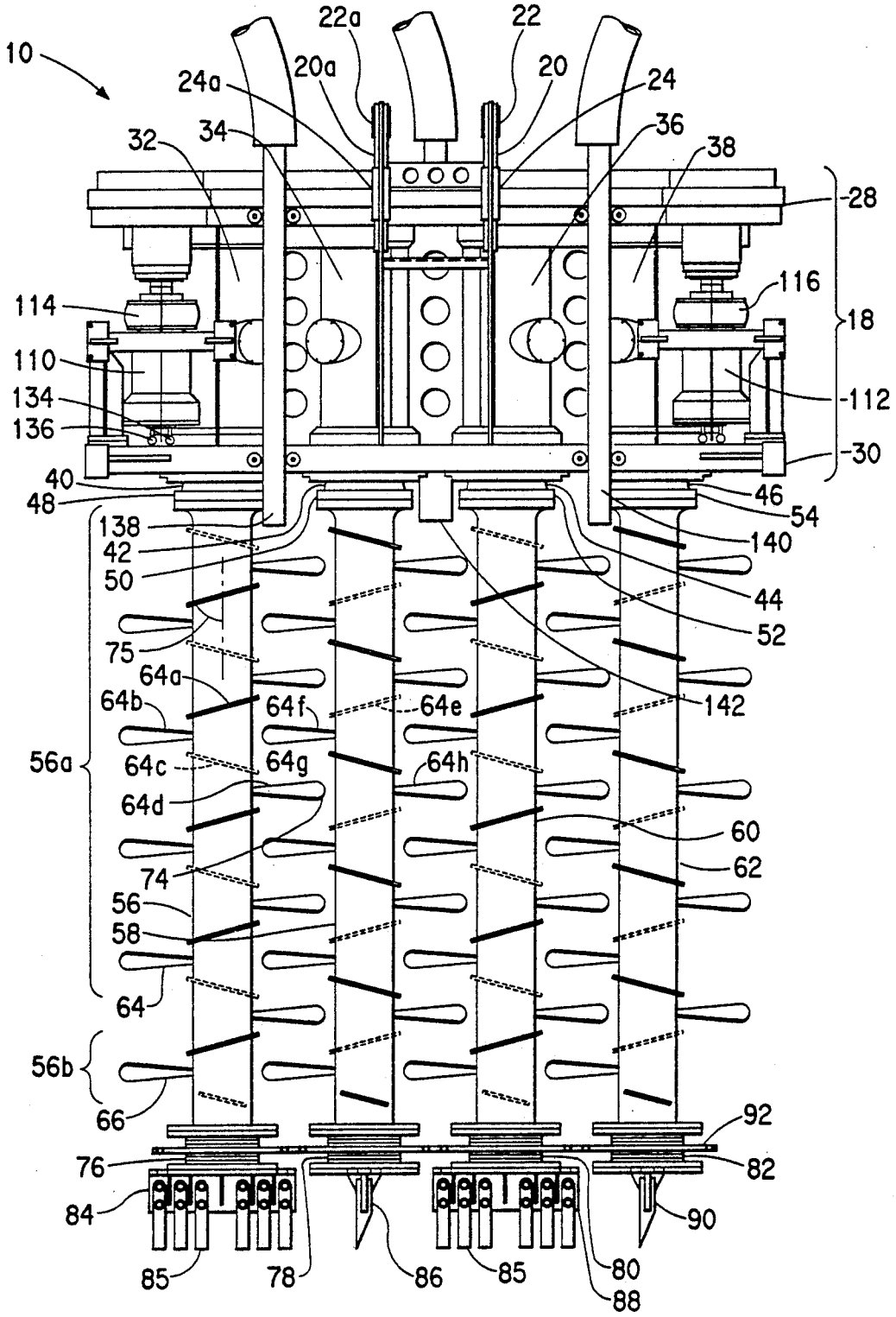
FIG. 2 is a front elevational view of the apparatus for in situ treatment of a medium according to the present invention.

As embodied herein, the present invention includes an apparatus for in situ treatment of a medium. Such an apparatus is shown generally at 10 in FIG. 2. Apparatus 10 comprises a housing 18. Housing 18 comprises an upper plate 28 and a lower plate 30 as shown in FIG. 2. Upper plate 28 and lower plate 30 are connected by tubular spacers 32, 34, 36 and 38 arranged in a linear array.

The apparatus of the present invention also comprises a plurality of counter-rotating shafts. Each shaft includes an upper shaft 40, 42, 44 and 46, respectively, and a mixing shaft 56, 58, 60 and 62, respectively. Housing 18 is disposed around each shaft, specifically, around the upper shafts, above the surface of the medium. Upper shafts 40, 42, 44 and 46 terminate outside housing 18 at a plurality of flanged ends 48, 50, 52 and 54, respectively, which are attached by bolts to flanged ends of mixing shafts 56, 58, 60 and 62. Upper shafts 40, 42, 44 and 46 extend through lower plate 28, spacers 32, 34, 36 and 38, respectively, and upper plate 30, and are supported for rotation by bearings (not shown) in a conventional manner within the spacers at the upper and lower plate.

Figure 4:
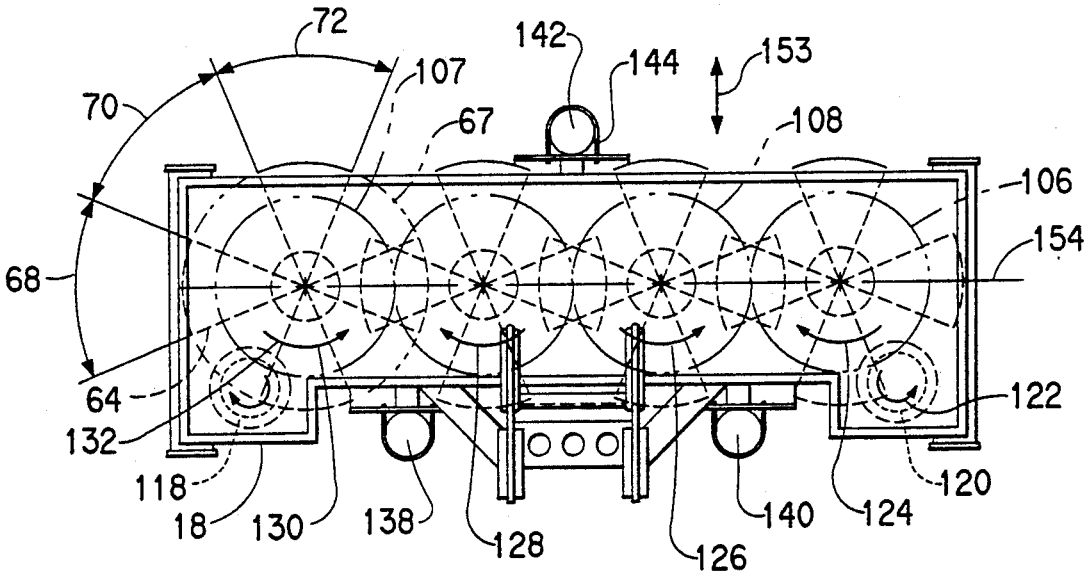
FIG. 4 is a plan view of the apparatus of FIG. 2.

The apparatus of the present invention also comprises a plurality of blades, some of which are shown at 64*a–h* as shown in FIG. 2, disposed on each of the shafts. Specifically, the blades are disposed on each mixing shaft 56, 58, 60 and 62. For instance, mixing shaft 56 comprises an array of individual blades, some of which are shown at 64*a–d*, which defines a clockwise spiral array, looking from the housing end (i.e., the top) of shaft 56, while an array of blades, some of which are shown at 64*e–h*, defines a counterclockwise spiral array on adjacent mixing shaft 58. As noted above, shafts 56, 58, 60 and 62 counter-rotate; for instance, shaft 56 rotates counterclockwise as shown by arrow 130, and shaft 58 rotates clockwise as shown by arrow 128 as shown in FIG. 4. A mixing zone is formed in the vertical volumetric space between each vertically spaced blade on each respective shaft and in the lateral volumetric space between laterally spaced blades on adjacent shafts.

In a preferred embodiment, the blades and spaces are arranged on each mixing shaft in a helical (spiral) array. The helical array of blades on one mixing shaft are disposed in an opposite-hand helix with respect to the helical array disposed on an adjacent shaft. This helical array of blades on a shaft defines a segmented, spiral auger assembly as illustrated in FIG. 2. Blades 64*a–d* on shaft 56 are 180° out of phase with blades 64*e–h* on shaft 58. That is, blade 64*a* starts on the front of shaft 56, while blade 64*e* starts on the back of shaft 58. This allows adjacent spiral arrays of blades to intermesh or overlap, without mechanical interference of the blades on one shaft with the blades on an adjacent shaft. This overlap is such that the tip of a blade, such as tip 74 of blade 64*d* on shaft 56 just clears the periphery of shaft 58, as shown in FIG. 2. The intermeshing overlap keeps the blades and the mixing shafts from clogging with solids and promotes continuous mixing along the linear array of mixing shafts, i.e., laterally among mixing shafts 56, 58, 60 and 62.

Figure 5:
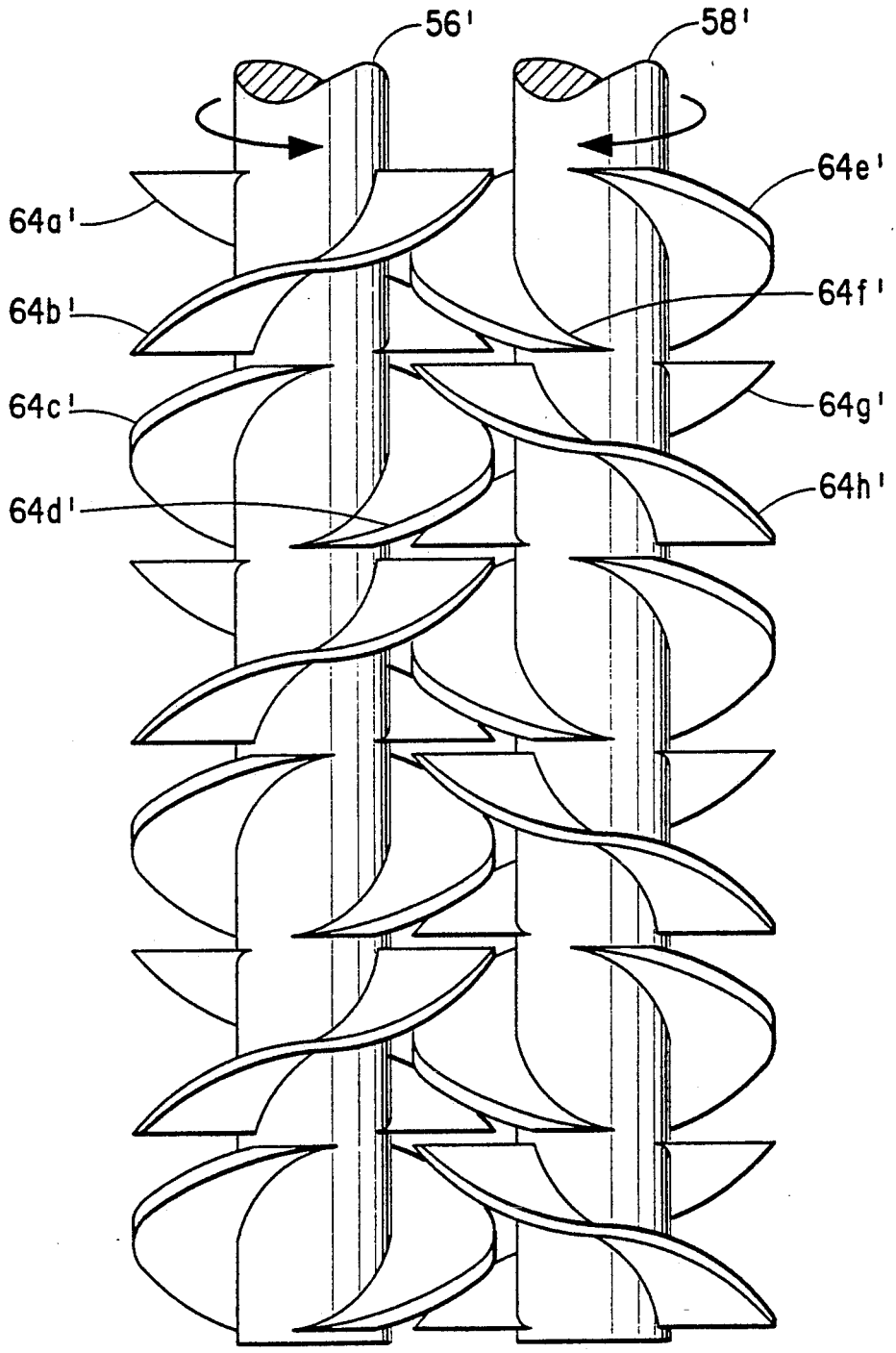
FIG. 5 is an alternative design for the mixing shafts according to another embodiment of the apparatus of the present invention.

The blades, although arranged in a spiral array having a particular pitch and helix angle as shown in FIG. 2, may have a planar surface instead of a contoured surface, as does a true helical array. The individual planar blades, such as blade 64*a*, may be oriented at a variety of angles relative to the shaft axis, which angles, such as angle 75 as shown in FIG. 2, may be different than the helix angle of the array. In a preferred embodiment, angle 75 is 75°. In an alternative embodiment as shown in FIG. 5, an array of blades is disposed on a shaft 56', some of which are shown at 64*a'–d'*, and an array of blades is disposed on a shaft 58', some of which are shown at 64*e'–h'*. The array of blades on shaft 58' is oriented 90° out of phase with the array on shaft 56' to provide intermeshing blades similar to the embodiment shown in FIG. 2. Also, the array of blades on shaft 58' mirrors the array of blades on shaft 56'. Thus, for simplicity's sake, only the configuration of the array of blades on shaft 56' is described herein, it being understood that the same description holds for the blades on shaft 58'. The array of blades on shaft 56' may be two clockwise flights, such as 64*a'* and 64*b'* and of a true helix, such as a wood drill auger. Every 180°, the helix is interrupted by a 90 degree space and is then followed by two more clockwise flights of blades, such as 64*c'* and 64*d'* on shaft 56'.

The blades are disposed about the mixing shafts so that the tip circle of the blades on one shaft overlap the tip circle of the blades on an adjacent shaft. The tip circle of one of the blades is shown in dotted outline at 67 in FIG. 4. The blades on one shaft thus intermesh with the blades on an adjacent shaft. Each blade, for example, may occupy 45° of circumference as shown at 68 in FIG. 4, followed by a space of 45°, as shown at 70, followed by the next blade, which also occupies about 45° of circumference, as shown at 72, and so on. In a preferred embodiment, each blade occupies about 60° of circumference, and each space occupies about 30° of circumference. It should be noted that the spacing and number of blades and the angle of the blade relative to the shaft axis may be varied without departing from the scope or spirit of the invention.

As shown in FIG. 2, the mixing shafts include a first section 56*a* and a second section 56*b*. The blades of first section 56*a* have a first radius, and the blades of second section 56*b* have a second radius. The second radius is smaller than the first radius. The blades in the second section are tapered in a decreasing manner, wherein the blades having the larger radius are disposed at the end of the shafts nearer the housing. In a preferred embodiment, there are three (3) blades in the second section as shown in FIG. 2. Each mixing shaft and the blades disposed thereon comprise an auger assembly, which is configured to be suitable for a predetermined medium. Each auger assembly is replaceable with a different auger assembly suitable for a different medium. For example, one auger assembly may be suitable for treating fluid sludges and may be replaced with another auger assembly which is suitable for treating sandy soils.

Figure 3:
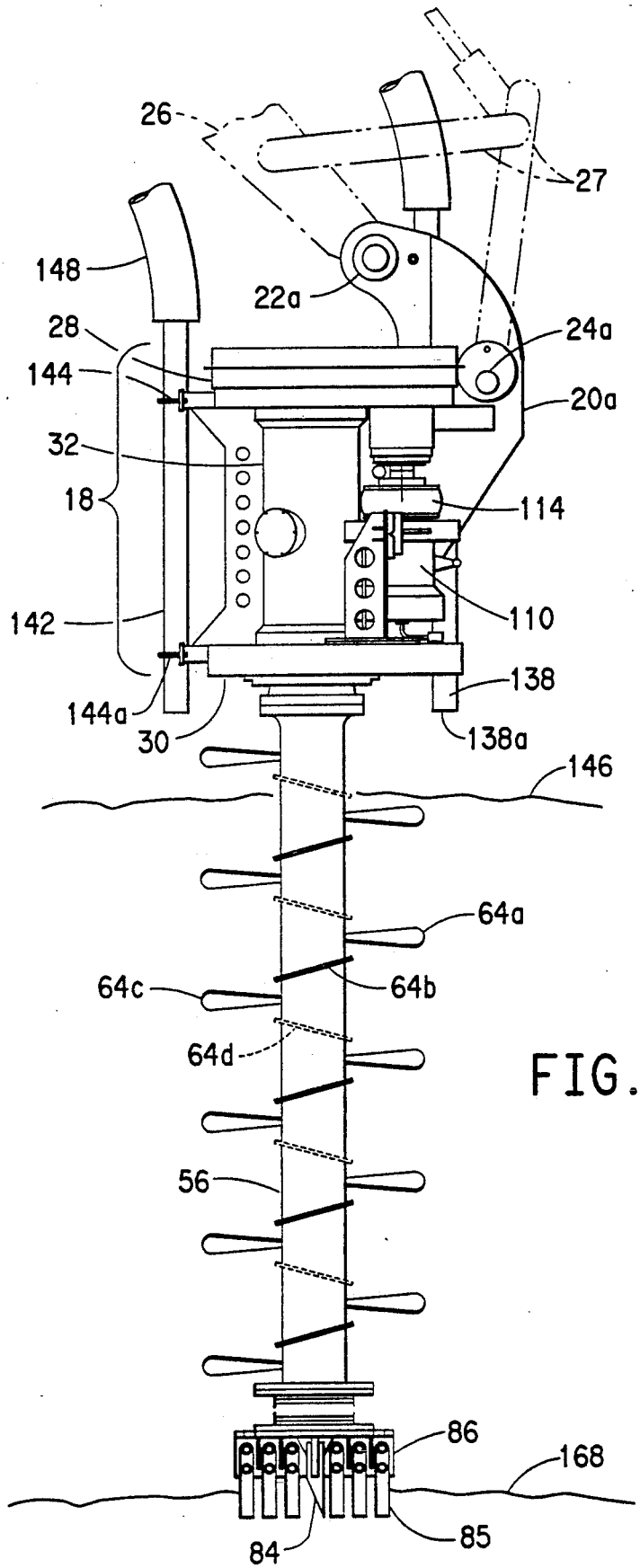
FIG. 3 is a side elevation view of the apparatus of FIG. 2.

The apparatus of the present invention also comprises a cutting tooth assembly disposed at one end of each of the mixing shafts for cutting through the medium and through obstructions in the medium. As shown in FIGS. 2 and 3, a cutting tooth assembly, such as 84, 86, 88 and 90, is disposed at one end of mixing shafts 56, 58, 60 and 62, respectively. Each cutting tooth assembly 84, 86, 88 and 90 comprises bucket teeth 85 and is attached to a plurality of bearing spools 76, 78, 80 and 82, respectively. Like the blades, the cutting teeth on the cutting tooth assembly of each respective shaft must be of the opposite hand since the shafts counter-rotate. Each cutting tooth assembly can be easily changed for maintenance or replacement with a different assembly uniquely adapted to a particular medium. In a preferred embodiment, the cutting tooth assembly includes commercially available excavator bucket teeth, such as those sold by Caterpillar, Inc. of Peoria, Ill. In the preferred embodiment, the cutting tooth assemblies cut, or break up, the bottom six (6) to twenty-four (24) inches of the medium, such as soil in a sludge pond, where infiltration of hazardous waste may have occurred.

Alternatively, the cutting tooth assembly may comprise a boring head attachment for drilling augers, such as a boring head attachment which is commercially available from Pengo Corp. of Union City, Calif. In this alternative embodiment as shown in FIG. 2A, a cutting tooth assembly 84' includes a linear array of teeth 85' extending from either side of a center shaft 87, much like the tooth array of FIG. 2. However, the teeth of cutting tooth assembly 84' are angled from the vertical in a direction toward the direction of rotation of the shafts to cut into and lift the medium, such as soil at the bottom of a sludge pond, better than straight teeth can. Thus, cutting tooth assembly 84' may be used in lieu of cutting tooth assembly 84. Assembly 84' has a flange 91 that attaches to the bottom of a bearing spool, such as 76. The cutting tooth assembly is bolted to the spools, so that the assembly can be readily removed and replaced for maintenance or exchanged with a different assembly particularly suited to a particular medium, as in the arrangement of FIGS. 2 and 3. Cutting tooth assembly 84' includes a pilot tip 89 at the center bottom thereof as shown in FIG. 2A. Pilot tip 89 usually engages the bottom medium first, at least on a flat, non-sloping bottom, so that the teeth have less tendency to apply undesirable side loads to the mixing shafts when they encounter obstructions or discontinuities, such as rocks or cavities, that cause uneven cutting forces from one side of the tooth assembly to the other. The pilot tip also provides a stabilizing force whenever the cutting tooth assembly evenly engages the bottom of the pond.

Figure 6:
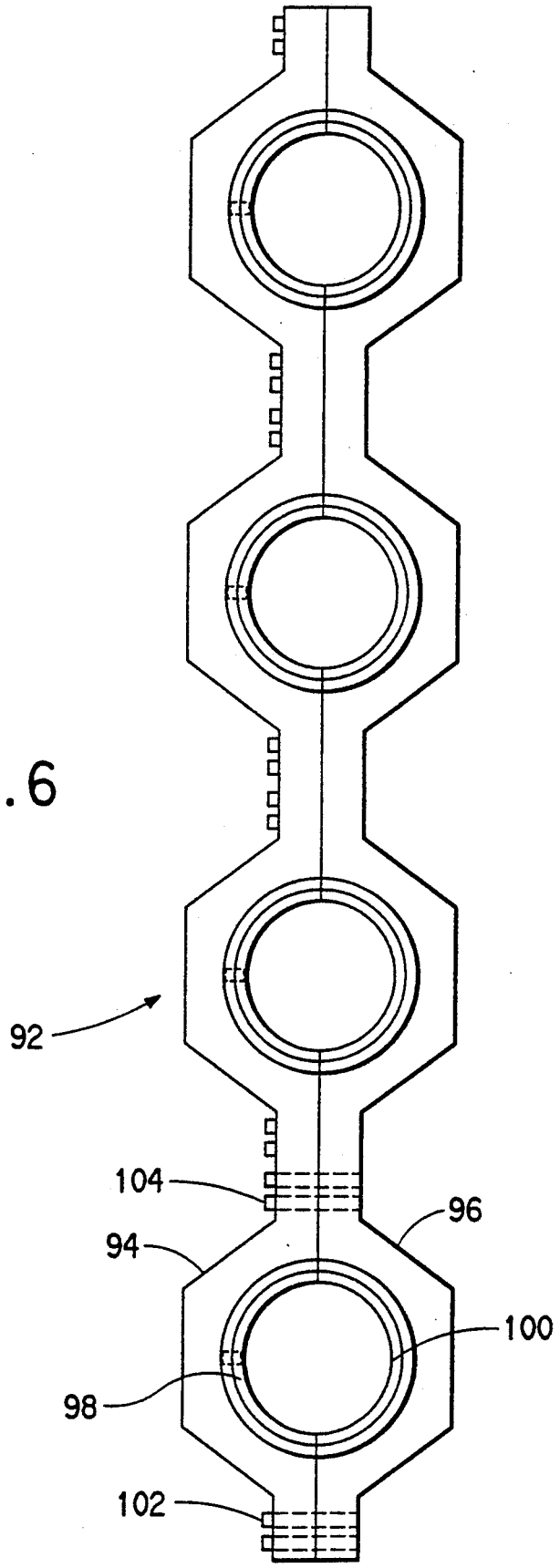
FIG. 6 is a plan view of the bearing bar assembly of the apparatus of the present invention.

The apparatus of the present invention further includes a bearing bar assembly 92 as shown in FIGS. 2 and 6 engaging mixing shafts 56, 58, 60 and 62 for limiting the deflection of the shafts. Bearing bar assembly 92 includes a plurality of bearing spools 76, 78, 80 and 82. Bearing spools 76, 78, 80 and 82 engage the bottom, or unsupported ends, of mixing shafts 56, 58, 60 and 62, respectively, to stabilize these unsupported ends and limit deflection of the ends of the mixing shafts that first contact the medium, should they encounter an obstruction, such as a rock. The bearing bar assembly has minimum dimensions to reduce resistance to travel vertically and horizontally through the medium and to minimize interference with vertical pumping. Bearing bar assembly 92 includes a first bar half 94, a second bar half 96 and two polymeric bearing sleeve halves, 98 and 100, for each spool 76, 78, 80 and 82. If desired, for ease of assembly, each half may be further divided into an upper and a lower portion to provide four portions for each spool. The two bar halves are held together by bolts, such as 102 and 104. For some mediums, such as sludge ponds that are easily fluidized, have only small particulates, minimal debris and a soft bottom, the bearing spools and the bearing bar may be omitted from the apparatus of the present invention.

The apparatus of the present invention further comprises a plurality of reagent supply conduits 138, 140 and 142 as shown in FIGS. 2–4 disposed in fluid communication with the mixing zones for directing at least one reagent to the medium. Reagent supply conduits 138, 140 and 142 are disposed in fluid communication with the mixing zone at the nips of the blades. The medium and the reagent are pumped along the shafts in the mixing zones as the shafts counter-rotate. In addition, it should be noted that some of the medium is pumped upwardly at the trailing edges of the mixing zones as the counter-rotating shafts traverse the medium. Supply conduits 138, 140 and 142 are mounted in adjustable brackets, such as 144 and **144*a* as shown in FIG. 3, for permitting vertical adjustment of the conduits so that the location of the addition of reagent may be varied. For instance, with the present invention, it is possible to supply the reagent above or at the surface of the medium, or below the surface of the medium. Alternatively, the mixing shafts may include a passage formed along the axial length thereof for injecting the reagents into the medium at the bottom of the shafts. However, this alternative is not preferred because of the additional complexity of the rotary joints on the shafts and the difficulty in detecting pluggages in the shafts and in cleaning out the shafts as a result thereof. In a preferred embodiment as shown in FIG. 3, reagents are added at the surface of the medium, such as at 146, and are pumped along the shafts, along with the medium by the blades on the mixing shafts. Flexible lines, such as 148 on conduit 142 as shown in FIG. 3, may be connected to a distribution manifold and subsequently to a pump in a conventional reagent delivery system located adjacent to apparatus 10. Nozzles (not shown) may be attached to the ends, such as 138*a*** as shown in FIG. 3, of the reagent supply conduits, to create back pressure to regulate flow in the reagent delivery system. The nozzles may include a mechanism (also not shown) for diverting flow into a plurality of sub-streams.

The reagent composition depends on the particular medium being stabilized. Typical reagents that may be used with the present invention include limes in the form of calcium oxide, calcium hydroxide and milk of lime, suitable clay products, lime kiln dust, portland cement and grout. The reagents may be delivered in a water slurry, in dry form, such as a dry powder or as pellets, or in other flowable form. The use of a reagent in a dry form, such as a powder or pellet, is necessary when the reagent is a material such as calcium oxide or lime kiln dust that hydrates rapidly in the presence of water or when the solid content of the medium being treated is low. The most simple way to deliver reagent dry is to pneumatically convey the reagent in a high-velocity air stream and inject the air and the entrained reagent below the surface of the medium. This injection method, while simple, has the disadvantage that dust-filled air bubbles form in the medium as a result. When these air bubbles work their way to the surface of the medium, they burst, releasing a considerable amount of reagent dust into the air. The present invention avoids this problem by pumping the air/reagent bubbles downwardly with the blades, effectively dispersing the reagent in the medium and thus eliminating this dusting nuisance. Alternatively, dry reagent dusting can be controlled by enclosing housing 18 and reagent supply conduits 138, 140, 142 in a shroud, not shown, that extends downwardly to near surface 146 of the medium. The shroud is kept under negative pressure to exhaust any dust into a collection device, also not shown. This same shroud and exhaust system could also be used to control emissions of volatile organic compounds, where necessary.

Referring again to FIGS. 2 and 4, each of the upper shafts extends above the bearing spools at upper plate 28 and is attached to a spur gear, such as 106, that is engaged with a spur gear, such as 108, of the adjacent shaft for counter-rotating the shafts. A pair of fluid motors 110 and 112 are disposed at the two ends of housing 18 and are attached via couplings 114 and 116 to pinion gears 118 and 120, respectively. It should be noted that the preferred embodiment includes two relatively small, balanced motors instead of one. The pinion gears engage the spur gears, e.g., pinion gear 120 engages spur gear 106, and pinion gear 118 engages spur gear 108 as shown in FIG. 4. Both fluid motors 110 and 112, respectively, drive interengaged spur gears 107 and 106 simultaneously, with adjacent spur gears rotating counter to each other as shown by arrows 122 and 132 in FIG. 4 for the pinion gear and arrows 124, 126, 128 and 130 for the spur gears. Fluid is supplied to fluid motors 110 and 112 through flexible pressure lines (not shown) to ports, such as 134 and 136, on motor 110. The flexible lines are connected to a conventional hydraulic pressure source and flow control valve to control the direction of rotation of the fluid motors and their speed.

Figure 7:
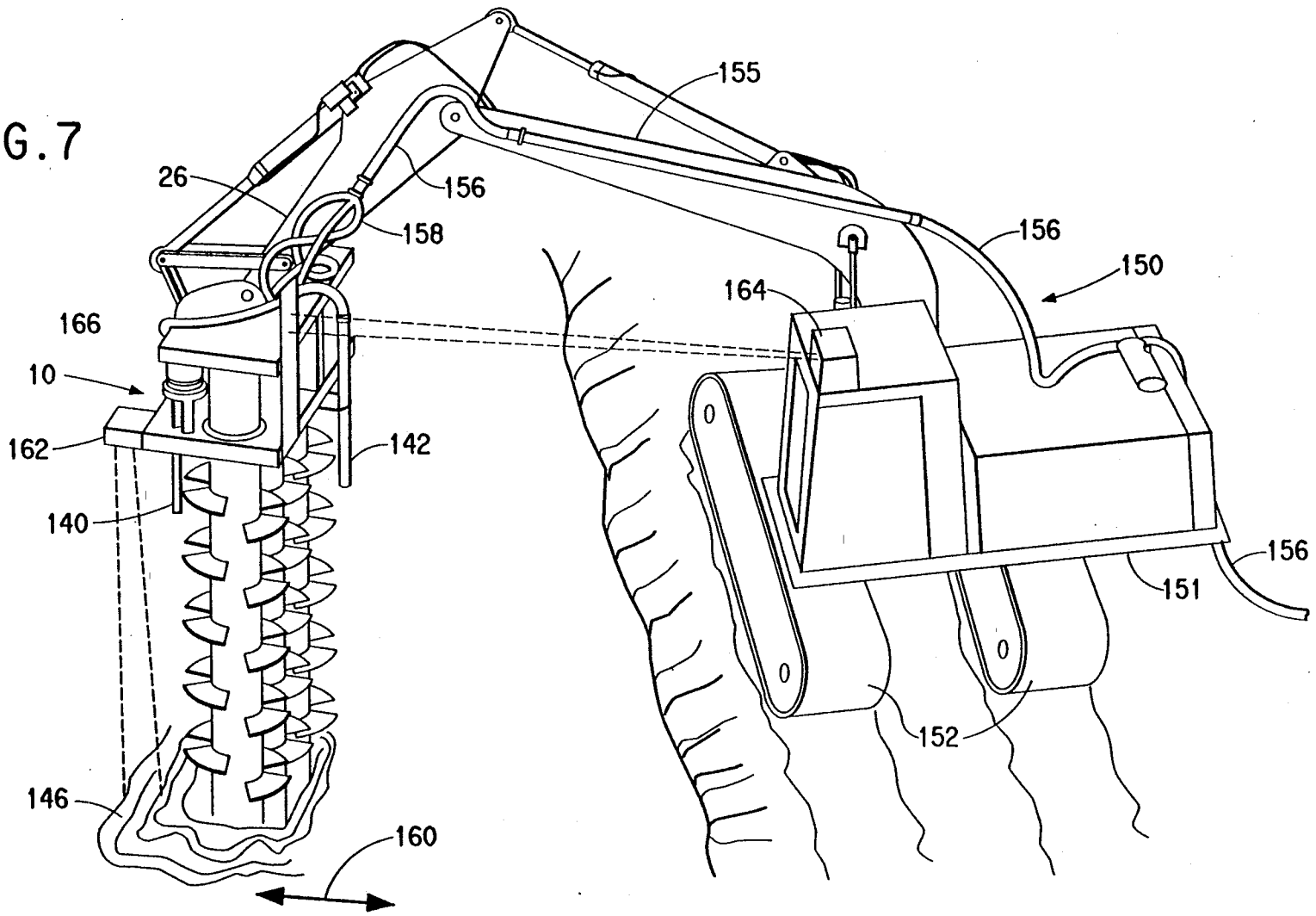
FIG. 7 is a perspective view showing the shaft moving mechanism of the apparatus of the present invention.

The apparatus of the present invention also comprises means for moving the shafts below the surface of the medium in the vertical direction generally parallel to the plane of the axes of the shafts and in the horizontal direction generally perpendicular to the plane of the axes to define a volume in the medium. This volume is typically an essentially rectangular parallelepiped, due to the configuration of the mixing shafts. In one preferred embodiment, the volume is 16 feet long, 9 feet wide, and the depth of the volume is determined by the depth of the medium. The shaft moving means may comprise a vehicle 150 which moves along tracks 152 as shown in FIG. 7. An example of a commercially available tracked vehicle is a Caterpillar 235C TM excavator, sold by Caterpillar, Inc. of Peoria, Ill. Alternatively, the shaft moving means may comprise a gantry. The shaft moving means may also comprise any type of vehicle capable of moving the shafts, it being understood that the shaft moving means may include any means capable of imparting movement to the shafts. It may even be possible to move the shafts by hand in a small-scale application.

As FIG. 7 shows, tracked vehicle 150 includes a stick 26, a boom 155 and an upper carriage 15 1. Stick 26 is pivotally attached to boom 155, and boom 155 is pivotally attached to upper carriage 151. Stick 26 is operatively attached to upper shafts 40, 42, 44 and 46 by a pair of brackets **20, 20*a* and a plurality of links 27 as shown in FIG. 3. The excavator stick and links are shown only in phantom in FIG. 3. Brackets 20 and 20*a* have pin holes 22, 22*a* and 24, 24*a*, respectively, formed therein with pins extending between each pair of pin holes 22, 22*a* and 24, 24*a* to connect the brackets to stick 26. The upper shafts, and the auger assemblies attached respectively thereto, are oriented and deployed using the tracked vehicle's hydraulic controls. The hydraulic fluid for driving the shafts is supplied by a separate high-flow hydraulic system, not shown, which may be mounted on the rear of upper carriage 151. Reagent is supplied to apparatus 10 from an external source behind the tracked vehicle, not visible in FIG. 7. The reagent is pumped to apparatus 10 through a large, flexible hose 156 shown extending from behind tracked vehicle 150 and passing along the structure of the tracked vehicle. The reagent is divided into three streams by a manifold 158 to divert the flow of the reagent to the separate reagent supply conduits, 138, 140 and 142. The operator of the tracked vehicle moves the shafts toward and away from the vehicle in the direction of arrows 160. Normally, vehicle tracks 152 are oriented parallel to the edge of the medium as shown in FIG. 7**, so that the shafts can also be easily moved along the edge of a body of the medium, such as a sludge pond.

The movement of the shafts through the medium may be analogized to moving a portable electric mixer through a batter. The medium and the reagent are mixed vertically and laterally in the mixing zones and are further mixed horizontally as the mixing zones traverse the medium in the horizontal direction. The reagent and the medium are thus mixed in the volume in both the horizontal and the vertical direction to stabilize and homogenize the medium. In contrast, in systems of the prior art, the blades move through the medium only in the vertical direction, and the rotating shafts are horizontally stationary. In such systems, no horizontal mixing between horizontally successive advances of the shafts of the medium occurs. Moreover, with the present invention, during the horizontal traversal of the shafts through the medium, the downward force of the shafts on the medium causes some circulation of the medium from the bottom to the top of the medium at the trailing side of the shafts, which actually enhances vertical mixing. Accordingly, with the present invention, uniform mixing of any stratified layers to form a homogenous medium is much more thorough than could be previously achieved by systems of the prior art.

Further in accordance with the present invention, there is provided a method of treating a medium in situ. The method comprises the steps of positioning a vehicle having a boom and a stick connected to the shafts at a first position on the edge of the medium with the forward direction of the motion of the vehicle generally parallel to the edge of the medium. The boom and stick of the vehicle are then extended over the medium to position the shafts above the surface of the medium. Fluid motors 110 and 112 are energized for rotation at about 15–20 rpm, which thereby rotates adjacent shafts in counter-rotating directions. The vehicle operator orients the counter-rotating shafts, which have a plurality of blades disposed thereon, vertically and lowers them into the medium until the cutting tooth assemblies contact the bottom of the medium at the low point of the volume to be treated. Resistance to lowering the shafts can be sensed by the operator. The cutting tooth assemblies may be used to cut through a shallow layer of soil at the bottom of the pond that may be contaminated, so as to mix the soil at the bottom of the pond with the overburden of medium and reagents. An ultrasonic depth sensor 162 as shown in FIG. 7 is used to establish the depth of the cutting tooth assemblies by measuring the distance from the sensor to surface 146 of the medium. The shaft speed is then increased to about 60–75 rpm, and at least one reagent is directed into the medium via supply conduits 138, 140 and 142. A mixing zone is formed in the vertical volumetric space between each vertically spaced blade on each respective shaft and in the lateral volumetric space between laterally spaced blades on each adjacent shaft. The medium and the reagent are pumped along the shafts in the mixing zones as the shafts counter-rotate. The amount of reagent that is required for a particular type of medium is determined by small-scale laboratory tests for samples of that medium. The reagent is supplied at a suitable rate, which is typically a flow velocity sufficient to prevent reagent from dropping out of suspension in the lines. The operator then moves the shafts below the surface of the medium in a direction generally perpendicular to the plane of the axes of the shafts as shown at 154 in FIG. 4 to define a first volume in the medium. The shafts cut a level bottom 168 as shown in FIG. 3. The horizontal motion of the shafts is measured by a second ultrasonic sensor 164 in conjunction with a target 166 which extends between upper and lower plates, 28 and 30, respectively, of housing 18. The medium and the reagent are mixed vertically and laterally in the mixing zones and are further mixed horizontally as the mixing zones traverse the medium in the horizontal direction, generally in the direction of arrows 153 as shown in FIG. 4. The reagents and the medium are thereby mixed in both the vertical and the horizontal direction to stabilize and homogenize the medium. The reagent continues to be directed into the medium while the blades traverse the medium in the horizontal direction until the desired amount of reagent has been added. When reagent injection is complete, the shafts may continue to traverse the medium in the horizontal direction an additional length of time to ensure thorough mixing, which may be, for example, three minutes after adding the reagents at a shaft speed of 60 rpm. The exact length of time the shafts traverse the medium depends on the uniformity of the medium-reagent mixture that is required.

The method of the present invention further comprises the steps of raising the shafts above the surface of the medium while continuing to rotate the shafts after the shafts have been moved through the medium for the desired length of time. The operator then moves the vehicle to a second position, which is spaced a predetermined distance from the first position on the edge of the medium. The operator extends the boom and stick on the vehicle over the medium to position the shafts above the surface of the medium, lowers the shafts vertically into the medium and directs at least one reagent into the medium when the vehicle is at the second position. The operator then moves the shafts below the surface of the medium in the horizontal direction to define a second volume. The medium and the reagent are mixed vertically and laterally in the mixing zones and are further mixed horizontally as the mixing zones traverse the medium in the horizontal direction, again generally in the direction of arrows 153 as shown in FIG. 4. The reagents and the medium are thereby mixed in the second volume in both the horizontal and the vertical direction to stabilize and homogenize the medium. The method of the present invention is particularly suited for treating sludge in a pond, because sludge is relatively fluid, as compared to soil. Thus, it is only necessary to move the shafts once in the vertical direction and it is possible to traverse the shafts through the volume. In addition, the method may be used to treat a variety of other mediums.

Further in accordance with the present invention, there is provided a method for treating soil in situ. The method comprises the steps of lowering a plurality of counter-rotating shafts vertically into the soil, where each shaft has a plurality of blades disposed thereon and a mixing zone is defined in each space between vertically adjacent blades on each shaft. At least one reagent is directed into the soil so that the soil and the reagent are pumped along the shafts in the mixing zones as the shafts counter-rotate in a manner similar to that described above. The shafts are raised above the surface of the soil and are then moved to a second position spaced a predetermined distance from the first position. The steps of lowering the shafts vertically into the soil and directing at least one reagent into the soil are repeated for the second position. The shafts are then moved below surface of the soil in the horizontal direction generally perpendicular to the plane of the axes of the shafts between the first and the second positions to define a volume in the soil, wherein the soil and the reagent are mixed vertically and laterally in the mixing zones and are further mixed horizontally as the mixing zones traverse the soil in the horizontal direction. The reagent and the soil are thereby mixed in the volume in both the vertical and the horizontal direction to stabilize and homogenize the soil. In a preferred embodiment, the shafts are moved to a third and then a fourth position, and the blades traverse the soil in the horizontal direction between the first and the fourth position. The method as described in this paragraph is particularly suited for treating soils by utilizing the fluidizing effect of the reagent or the reagent slurry on the soil. This fluidized soil in adjacent volumes is thus more easily intermixed.

Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. An apparatus for in situ treatment of a medium, comprising:

(a) a plurality of counter-rotating shafts;

(b) a plurality of blades disposed on each of the shafts;

(c) a mixing zone formed in the vertical volumetric space between each vertically adjacent blade on each respective shaft and in the lateral volumetric space between laterally spaced blades on each adjacent shaft;

(d) a plurality of reagent supply conduits disposed in fluid communication with the mixing zones for directing at least one reagent into the medium, the medium and the reagent being pumped along the shafts in the mixing zones as the shafts counter-rotate; and (e) means for moving the shafts below the surface of the medium in the vertical direction generally parallel to the plane of the axes of the shafts and in the horizontal direction generally perpendicular to the plane of the axes of the shafts to define a volume in the medium, wherein the medium and the reagent are mixed vertically and laterally in the mixing zones and are further mixed horizontally as the mixing zone traverses the medium in the horizontal direction, thereby mixing the reagents and the medium in the volume in both the vertical and the horizontal direction to stabilize and homogenize the medium.

2. The apparatus as claimed in claim 1, wherein each shaft includes an upper shaft and a mixing shaft.

3. The apparatus as claimed in claim 2, wherein the blades are disposed about the mixing shafts so that the tip circle of the blades on one shaft overlaps the tip circle of the blades on an adjacent shaft.

4. The apparatus as claimed in claim 2, wherein the mixing shaft includes a first section and a second section, and further wherein the blades of the first section have a first radius and the blades of the second section have a second radius, the second radius being smaller than the first radius.

5. The apparatus as claimed in claim 2, wherein each mixing shaft and the blades disposed thereon comprise an auger assembly, wherein each auger assembly is configured to be suitable for a particular medium and is replaceable with a different auger assembly suitable for a different medium.

6. The apparatus as claimed in claim 2, further including a cutting tooth assembly disposed at one end of the mixing shafts for cutting through the medium and through obstructions disposed in the medium.

7. The apparatus as claimed in claim 2, further including a bearing bar assembly engaging the mixing shafts for limiting the deflection thereof.

8. The apparatus as claimed in claim 1, wherein the supply conduits are disposed in fluid communication adjacent the intersection of the tip circles of the blades.

9. The apparatus as claimed in claim 1, wherein the supply conduits are mounted in adjustable brackets for permitting vertical adjustment thereof so that the reagent may be delivered adjacent the surface of the medium.

10. The apparatus as claimed in claim 1, wherein the shaft moving means comprises a vehicle.

11. A method of treating a medium in situ, comprising the steps of:

(a) lowering a plurality of counter-rotating shafts vertically into the medium, each shaft having a plurality of blades disposed thereon and a mixing zone being formed in the vertical volumetric space between each vertically adjacent blade on each respective shaft and in the lateral volumetric space between laterally spaced blades on each adjacent shaft;

(b) directing at least one reagent into the medium, the medium and the reagent being pumped along the shafts in the mixing zones as the shafts counter-rotate; and (c) moving the shafts below the surface of the medium in the horizontal direction generally perpendicular to the plane of the axes of the shafts to define a first volume in the medium, wherein the medium and the reagent are mixed vertically and laterally in the mixing zones and are further mixed horizontally as the mixing zone traverses the medium in the horizontal direction, thereby mixing the reagents and the medium in the first volume in both the vertical and the horizontal direction to stabilize and homogenize the medium.

12. The method as claimed in claim 11, wherein the directing step includes directing the reagent at the surface of the medium.

13. The method as claimed in claim 11, further including the steps of:

(d) positioning a vehicle having a boom and a stick connected to the shafts at a first position on the edge of the medium with the forward direction of the motion of the vehicle generally parallel to the edge of the medium; and (e) extending the boom and the stick over the medium to position the shafts above the surface of the medium before step (a).

14. The method as claimed in claim 13, further including the steps of:

(f) raising the shafts above the surface of the medium after step (c);

(g) moving the vehicle to a second position spaced a predetermined distance from the first position on the edge of the medium; and (h) repeating the extending, lowering and directing steps for the second position; and (i) moving the shafts below the surface of the medium in the horizontal direction to define a second volume in the medium, wherein the medium and the reagent are mixed vertically and laterally in the mixing zones and are further mixed horizontally as the mixing zone traverses the medium in the horizontal direction, thereby mixing the reagents and the medium in the second volume in both the vertical and the horizontal direction to stabilize and homogenize the medium.

15. The method as claimed in claim 14, wherein the medium comprises sludge.

16. A method of treating soil in situ, comprising the steps of:

(a) lowering a plurality of counter-rotating shafts vertically into the soil, each shaft having a plurality of blades disposed thereon and a mixing zone being formed in the vertical volumetric space between each vertically adjacent blade on each respective shaft and in the lateral volumetric space between laterally spaced blades on each adjacent shaft;

(b) directing at least one reagent into the soil, the soil and the reagent being pumped along the shafts in the mixing zones as the shafts counter-rotate;

(c) raising the shafts above the surface of the soil;

(d) moving the shafts to a second position spaced a predetermined distance from the first position;

(e) repeating the lowering and directing steps for the second position; and (f) moving the shafts below the surface of the soil in the horizontal direction generally perpendicular to the plane of the axes of the shafts between the first and the second positions to define a volume in the soil, wherein the soil and the reagent are mixed vertically and laterally in the mixing zones and are further mixed horizontally as the mixing zone traverses the soil in the horizontal direction, thereby mixing the reagents and the soil in the volume in both the vertical and the horizontal direction to stabilize and homogenize the soil.

17. The apparatus as claimed in claim 1, wherein the reagent supply conduits are disposed completely outside the shafts.

18. An apparatus for in-situ treatment of a medium, comprising:

(a) a housing;

(b) a plurality of shafts arranged in a planar array, each shaft having an axis parallel to the axes of the other shafts, respectively, and each being rotatably supported at one end only by the housing;

(c) a plurality of individual blades disposed on each of the shafts, the blades on one shaft being arranged in a helical array and the blades on an adjacent shaft being disposed in an opposite-hand helix with respect to the helical array disposed on the one shaft, the blades on the one shaft being 180° out of phase with the blades on the adjacent shaft and the blades on the one shaft overlapping the blades on the adjacent shaft so that the tip of the blades of the one shaft just clears the periphery of the adjacent shaft and the tip of the blades of the adjacent shaft just clears the periphery of the one shaft;

(d) a spur gear attached to the end of each respective shaft and a pinion gear engaging at least one spur gear, the spur gear attached to the one shaft intermeshing with the spur gear attached to the adjacent shaft for rotationally coordinating the one shaft and the adjacent shaft so that said one shaft and said adjacent shaft rotate in opposite directions;

(e) a fluid motor attached to a respective pinion gear for rotating the intermeshing spur gears; and (f) at least one reagent supply conduit attached to the housing for directing a reagent to the medium for treating the medium in-situ.

19. The apparatus as claimed in claim 18, further including means attached to the housing for moving the housing and the shafts in a direction generally parallel to the shaft axes and in a direction generally perpendicular to the plane of the shaft axes, thereby defining a volume in the medium.

* * * * *